United States Patent [19]

Eckardt et al.

[11] 4,426,811

[45] Jan. 24, 1984

[54] METHOD OF AND APPARATUS FOR GRINDING THE EDGES OF GLASS SHEETS

[75] Inventors: Rudolf Eckardt; Hans-Cristoph Neuendorf, both of Wesel, Fed. Rep. of Germany

[73] Assignee: Flachglass Aktiengesellschaft, Gelsenkirchen, Fed. Rep. of Germany

[21] Appl. No.: 303,625

[22] Filed: Sep. 18, 1981

[30] Foreign Application Priority Data

Sep. 20, 1980 [DE] Fed. Rep. of Germany ..... 3035553

[51] Int. Cl.[3] ..... B24B 9/10; B24B 17/02

[52] U.S. Cl. ..... 51/101 R; 51/89; 51/215 R; 51/283 E; 83/281

[58] Field of Search ..... 51/101 R, 89, 103 C, 51/118, 127, 215 AR, 215 HM, 215 CP, 215 H, 283 R, 283 F, 215 R; 414/113, 121, 34, 67; 83/279, 280, 281, 251, 253

[56] References Cited

U.S. PATENT DOCUMENTS

| | | | |
|---|---|---|---|
| 2,088,737 | 8/1937 | Forbes | 51/101 R |
| 2,782,569 | 2/1957 | Robbins | 51/283 E X |
| 2,826,872 | 3/1958 | Robbins | 51/283 E X |
| 2,941,499 | 6/1960 | Gutzmer | 414/121 X |
| 3,693,321 | 9/1972 | Nilsson | 414/121 X |
| 3,878,650 | 4/1975 | Klotzbach | 51/101 R |
| 3,939,993 | 2/1976 | Lingl | 414/34 |

FOREIGN PATENT DOCUMENTS

| | | | |
|---|---|---|---|
| 2756443 | 6/1979 | Fed. Rep. of Germany | 51/101 R |
| 46419 | 6/1966 | German Democratic Rep. | . |

*Primary Examiner*—James G. Smith
*Assistant Examiner*—Robert P. Olszewski
*Attorney, Agent, or Firm*—Karl F. Ross; Herbert Dubno

[57] ABSTRACT

A method of grinding glass sheets whose edges are polygons that are not symmetrical about a point is carried out in an apparatus having a supply station for supporting a stack of such sheets with all of the sheets in the stack in vertical registration, a grinding station adjacent the supply station having a grinding table rotatable about an upright grinding axis and adapted to support the sheets during grinding, a template secured to the grinding table, and a pair of grinders in the grinding station radially engageable with the edges of the sheet on its grinding table and radially displaceable by the template. The method of the invention comprises the steps of transporting the sheets one at a time from the stack in the supply station to the grinding station, simultaneously engaging the grinders with the sheet in the grinding station while rotating this grinding table with its template and the sheet on the table through 180° to grind the edges of the sheet on the table, so that each such grinding operation displaces the template through 180° about the axis. Finally every other sheet is rotated while being transported from the supply station to the grinding station through 180° about an intermediate vertical axis.

6 Claims, 6 Drawing Figures

METHOD OF AND APPARATUS FOR GRINDING THE EDGES OF GLASS SHEETS

FIELD OF THE INVENTION

The present invention relates to a method of grinding the edges of glass sheets. More particularly this invention concerns such a method of grind-trimming the sheet edges automatically in an industrial process.

BACKGROUND OF THE INVENTION

It is standard practice in the industrial production of glass sheets, whether simple window glass, structural elements, mirrors, or the like, to roughly cut the sheets slightly oversize, and then to grind-trim them down to exact dimensions. For this grinding the sheet is supported on a table with its sheet edges overhanging the table above a template having a template edge geometrically congruent to, and normally of the same dimensions as, the shape the sheet is to have after grinding. A grinder radially engages the edge of the sheet with a feeler in engagement with the template edge so that as the table and template are rotated about a vertical axis or the grinder is orbited about the table, the grinder grinds the rough-cut sheet on the table down to a size corresponding exactly to that of the template.

In order to speed this operation a system described in German Patent No. 46,419 uses a pair of oppositely effective grinders. Thus opposite edges of the workpiece can be ground simultaneously so that the grinding operation itself is twice as fast. Such an arrangement requires that the workpiece be turned through 90° if it has four edges to be ground.

It has also been suggested to use a pair of diametrally opposite grinders that radially oppositely engage the sheet carried on a rotary grinding table. In such an arrangement it is only necessary to rotate the table through 180° to grind all its edges. Nonetheless, since each grinding operation rotates the table and template through 180°, it is of course necessary to reposition the table before depositing a new sheet on it, unless of course the sheets are symmetrical about a point. Accordingly the table must be turned back to its starting position after each such grinding operation in order to receive a new workpiece. Such a return step slows production.

As a rule the rough-cut sheets are simply stacked up in a supply station adjacent the grinding station. A carriage horizontally displaceable on overhead tracks is provided with lifters, normally of the vacuum or suction type, that are dropped down onto the topmost sheet of the stack and lifted to raise it so this sheet can be transported horizontally and deposited on the work table. Such an arrangement is described in German patent document No. 2,756,443.

Unless the rough-cut sheets are exactly positioned in the supply station and the transporter functions with great precision, normally necessitating very slow action to prevent the picked-up sheet from slipping laterally on the transporter, it is necessary for an operator in the grinding station to position the sheets exactly with respect to the template, that is position them in vertical registration above the template. If the workpiece is laterally offset it will be ground down too much on one edge and not at all on the opposite edge.

OBJECTS OF THE INVENTION

It is therefore an object of the present invention to provide an improved glass-sheet grinding method.

Another object is the provision of such a glass-sheet grinding method which overcomes the above-given disadvantages.

Yet another object is the provision of such a method which operates quite rapidly even with sheets whose edges are polygons that are not symmetrical about a point and wherein exact positioning of the workpiece with respect to the template is ensured.

SUMMARY OF THE INVENTION

These objects are attained according to the instant invention in a method of grinding glass sheets whose edges are polygons that are not symmetrical about a point. The method of the instant invention is carried out in an apparatus having a supply station for supporting a stack of such sheets with all of the sheets in the stack in vertical registration, a grinding station adjacent the supply station having a grinding table rotatable about an upright grinding axis and adapted to support the sheets during grinding, a template secured to the grinding table, and a pair of grinders in the grinding station radially engageable with the edges of the sheet on its grinding table and radially displaceable by the template. The method of the invention comprises the steps of transporting the sheets one at a time from the stack in the supply station to the grinding station, simultaneously engaging the grinders with the sheet in the grinding station while rotating this grinding table with its template and the sheet on the table through 180° to grind the edges of the sheet on the table, so that each such grinding operation displaces the template through 180° about the axis. Finally according to this invention every other sheet is rotated while being transported from the supply station to the grinding station through 180° about an intermediage vertical axis.

A considerable saving in valuable production time is realized when the steps of grinding one sheet and rotating the next sheet to be ground are carried out simultaneously. Thus as every other sheet is being grinded, the sheet being transported from the stack to the grinding station is rotated about the intermediate axis.

According to another feature of this invention the sheets are transported from the supply station to the grinding station by a transporter past an intermediate station. The method further comprises the steps of depositing the sheets in the intermediate station while transporting the sheets to the grinding station, positioning the sheets in the intermediate station exactly with respect to the transporter, and picking the positioned sheets up with the transporter and continuing their transport to the grinding station, whereby the sheets are exactly held by the transporter after such positioning and can be exactly deposited by the transporter in the grinding station. With such an arrangement the workpieces are both properly oriented—that is their angular position relative to the intermediate axis is adjusted—and exactly positioned—that is their horizontal position with respect to the intermediate axis is adjusted—so that they can be set right down in exactly the correct position and with the right orientation on the work table and grinding can begin immediately. The orientation and positioning both take place as the previous sheet is grinding, for a considerable time saving.

In accordance with yet another feature of this invention, the sheets are positioned in the station by being deposited on a positioning table in the intermediate station, and then shifted horizontally on the positioning table. This positioning table itself may be constituted as a turntable rotatable about the intermediate axis, so that it serves to orient the workpieces during their transporting from the stack to the grinding station.

The invention also includes an apparatus for grinding the edges of similar glass sheets whose edges are polygons that are not symmetrical about a point. The apparatus comprises a supply station supporting a stack of such sheets with all of the sheets in the stack generally in vertical registration, a grinding table at a grinding station adjacent the supply station and rotatable about an upright grinding axis for supporting the sheets during grinding, a template secured to and jointly rotatable with the grinding table, means including a pair of grinders in the grinding station radially oppositely engageable with the edges of a sheet on the grinding table and radially displaceable by the template, means including a transporter for transporting the sheets one at a time from the stack in the supply station to the grinding station, means for simultaneously engaging the grinders with the sheet in the grinding station while rotating the grinding table with the template and the sheet on the table through about 180° to grind the edges of the sheet on the table, whereby each such grinding operation displaces the template through 180° about the axis, and means for rotating every other sheet while transporting same from the supply station to the grinding station through 180° about an intermediate vertical axis.

The transporter according to this invention includes a glass-sheet holder rotatable about the intermediate axis and means for rotating the holder through 180° about the intermediate axis. In addition the apparatus includes means for positioning the sheet on the holder with respect to the intermediate axis. This intermediate axis itself, according to this invention, is fixed between the supply and grinding stations. The apparatus further comprises a positioning table at and rotatable about the intermediate axis between the stations, thus the sheets can be rotated through 180° about the intermediate axis by rotation of the positioning table.

DESCRIPTION OF THE DRAWING

The above and other features and advantages will become more readily apparent from the following, reference being made to the accompanying drawing in which.

SPECIFIC DESCRIPTION

Figures 1, 2, 3, 4, 5:
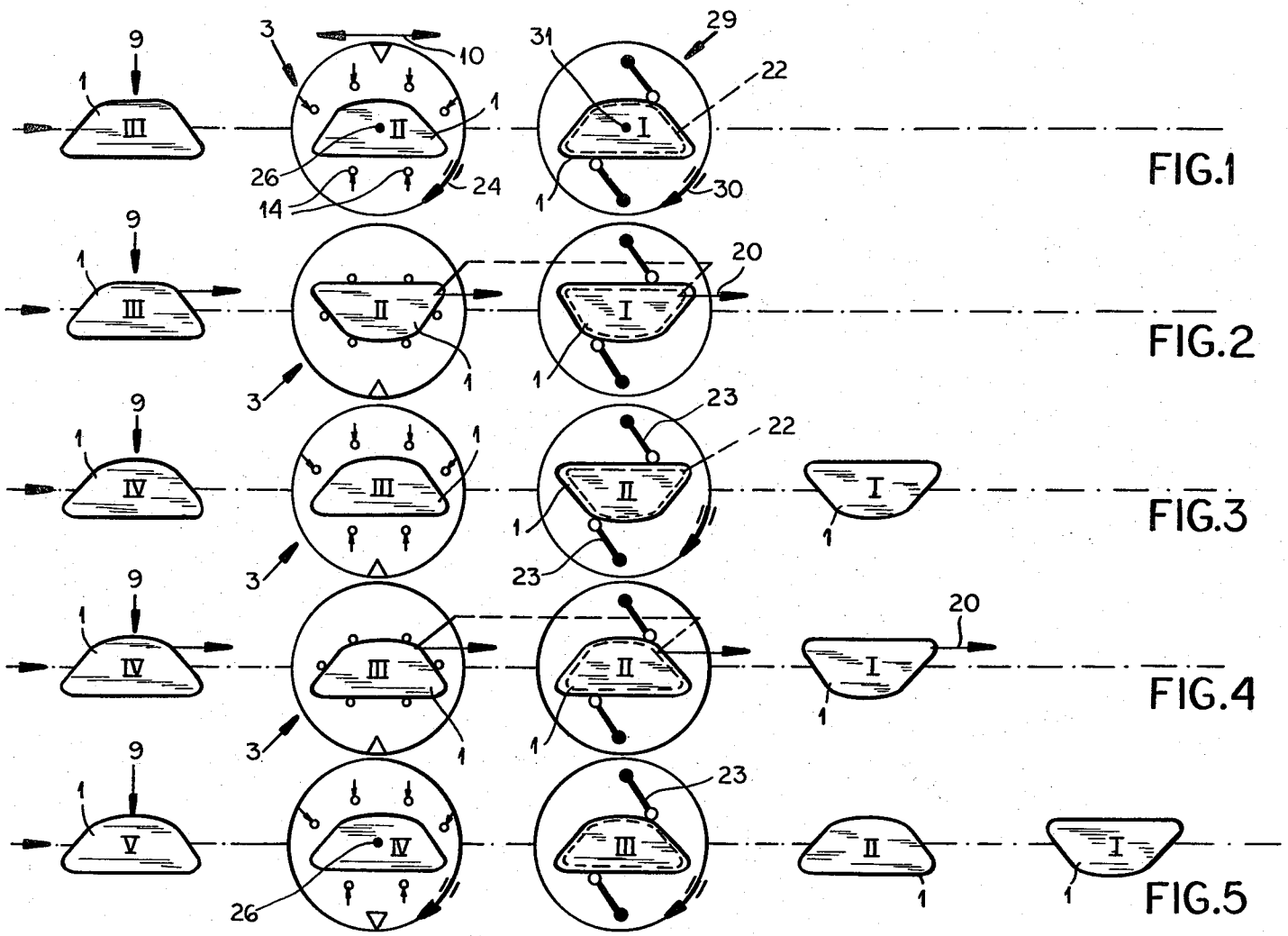
FIGS. 1–5 are schematic top views showing successive steps in the method according to the instant invention.

As seen in FIG. 1 a plurality of sheets 1, labeled successively I, II, III, IV, and V, are held in a supply station 9 in a stack in approximate vertical registration. These sheets 1 have trapezoidal peripheries so that they are not symmetrical about a point. The sheets are carried by a transporter 2 (see FIG. 6) described in more detail below to an intermediate station 3 wherein positioners 14 orient and position the sheets 1 with respect to a vertical intermediate axis 26. The sheets 1 are then carried to a grinding station 29 wherein grinders 23 of the type described in our copending application Ser. No. 303,610 and in above-cited German patent document No. 2,756,443 are urged radially against it at locations spaced diametrally apart with respect to a vertical grinding axis 31. The grinding station 29 is provided with a template 22 whose periphery is geometrically congruent to the shape the sheets 1 are to have once ground down by the grinders 23.

The first sheet I is shown in the grinding station where it is slowly rotated from its illustrated starting position around the axis 31 as indicated by arrow 30 while the grinders 23 each grind-trim a respective half of the workpiece periphery, the template 22 guiding the grinders 23. Meanwhile in the intermediate station 3 the positioners 14 are moved generally radially inward to properly orient the second sheet II while the entire workpiece is rotated about the axis 26 as indicated by arrow 24 synchronously with the first sheet I.

Once these two simultaneous operations are completed, as indicated in FIG. 2, the two sheets I and II are moved away in the transport direction 20 synchronously. This action moves the second workpiece II into the grinding station 29 and moves a third workpiece III into the positioning and orienting station 3.

The tools 23 are then engaged with the second sheet II as shown in FIG. 3 while the positioners 14 engage and position the third sheet III. This third sheet III is not, however, reoriented angularly since, as seen in FIG. 4, once the second sheet II is ground it is in the same orientation with respect to its axis 31 as the third sheet III is with its axis 26.

Thereafter as illustrated in FIG. 5 the third sheet III is moved into the grinding station 29 and a fourth sheet IV into the positioning and orienting station 3. The cycle then is repeated since the third and fourth sheets III and IV are in the same positions as the first and second sheets I and II of FIG. 1.

Figure 6:
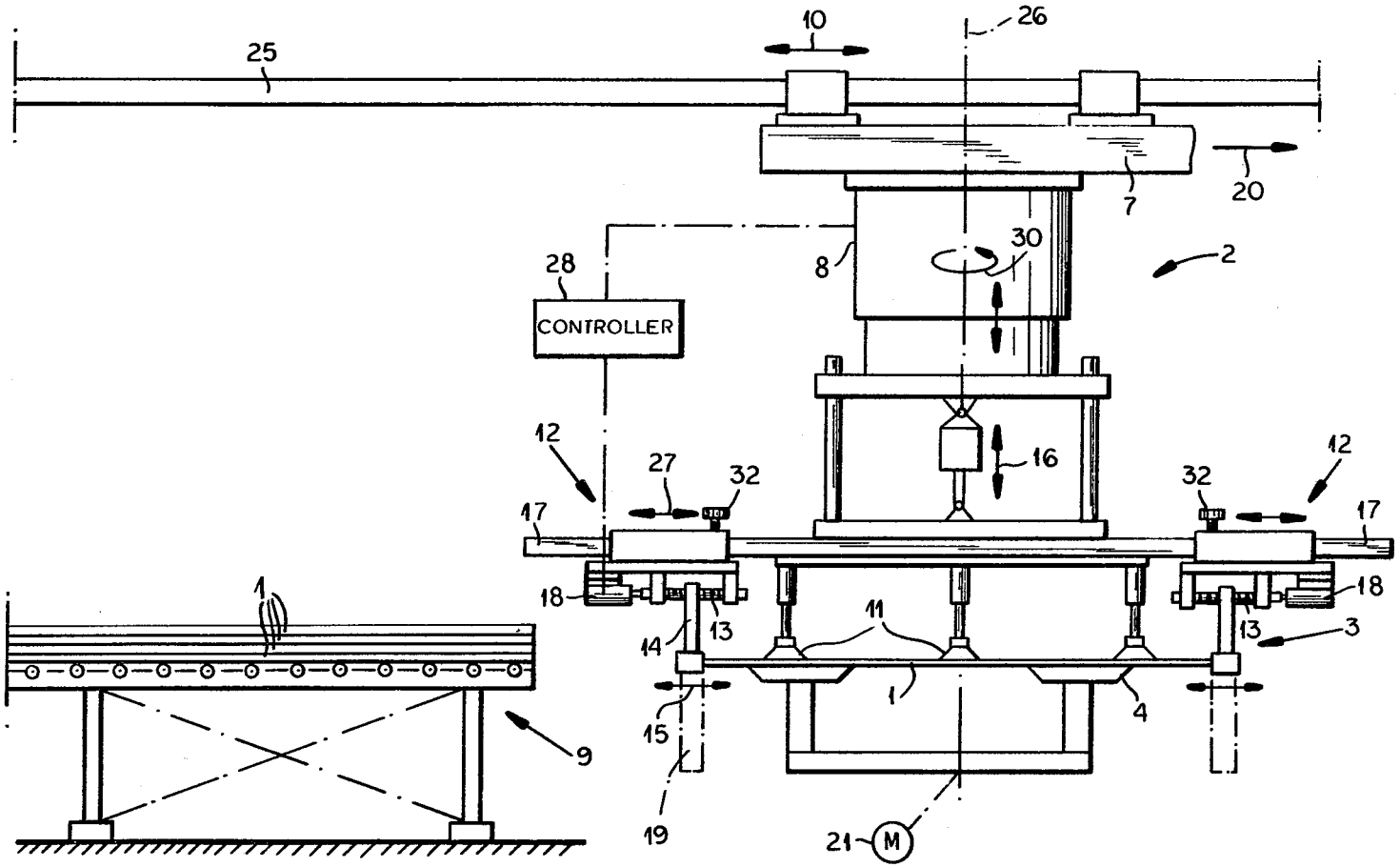
FIG. 6 is a side view of an apparatus suitable for carrying out some steps of the method of this invention.

As seen in FIG. 6 the stack of rough-cut glass sheets 1 lies atop a supply table at the supply station 9. The transporter 2 picks up these sheets 1 one at a time and carries them to an orienting and positioning station 3 having a work table 4 that can be rotated about the axis 26 by a motor 21 operated rom a controller 28. The transporter 2 has a carriage 7 displaceable horizontally as indicated by double-headed arrow 10 on tracks 25 between a position above the table 9 and a position above the table 4, and thence to a position in the grinding station 29. This carriage 7 has a compressed-air cylinder 8 effective along the vertical axis 26 as indicated by double-headed arrow 16. Horizontal arms 17 and suction lifters 11 are hung from the cylinder 8. The lifters 11 are of standard design and are connected to a vacuum arrangement so that when they are lowered down onto a sheet 1 they adhere to it with sufficient force that when raised they lift the sheet, only releasing it when the suction is cut.

The outer ends of the arms 17 are formed as rails which extend perpendicular to each straight side edge of the sheet 1 and which carry positioners 12 which are displaceable along these arms 17 as indicated by arrow 27. Each of these positioners in turn has one of the positioners 14 which is formed as a downwardly extending finger or positioning arm engageable with the sheet edge and itself carried on a threaded spindle 13 constituting the output shaft of a respective electric motor 18. Thus these positioners 14 can be moved by the respective motors 18 as shown by arrow 15.

In the illustrated arrangement the carriage 7 itself moves with great precision so that each time it comes to rest above the table 4 it is in an exactly determined position. The positions of the sheets 1 on the supply table 9 cannot be so accurately determined, and it is possible for the sheets 1 to shift slightly horizontally relative to the carriage 7 while being picked up, transported, and deposited. Furthermore it is fairly common for the sheet immediately underneath the topmost sheet to be picked up a little and shifted somewhat horizontally as the topmost sheet is lifted.

The motors 18 are controlled by standard limit switches to move the respective positioners 14 inwardly to predetermined positions on the respective spindles 13 and then to stop before the controller 28 reverses them and moves the pushers 14 back into the outer positions. Thus at the start of a production run the transporter 2 is into its depositing position in the grinding station 29 and the positioners 14 are moved into the inner positions shown in the drawing and then the all of the devices 12 are moved so that these pushers 14 lie exactly above the respective edges of the template 22, in which positions they are locked in place, as for example by screws 32.

Thereafter the pushers 14 are moved into their outer positions, in which they are held as the carriage 7 moves upstream to pick up a sheet and in which they remain until the carriage 7 has moved downstream and deposited the picked-up sheet 1 on the table 4. The controller 28 then operates the motors 18 to move the pushers 14 to their inner positions, which as described above have been set to correspond to the template edge. This action perfectly aligns the workpiece on the table 4.

Thereafter the sheet 1 is again picked up by the transporter and carried to the grinding station 29 where it is deposited in perfect vertical alignment with the template 22. The edges are then ground as described above and also as described in our above-cited, jointly filed, and copending application, to which reference should be made for more information.

After the sheet 1 is completely ground it is transported away in the direction indicated by arrow 20. This can be done by the same transporter 2 that brings it to the table 4, by another independent transporter, or by a transporter connected to the transporter 2 and displaceable jointly therewith.

It is also possible to provide the positioners 14 with downward extensions 19 that engage the template 22 for the initial setting.

Thus the system according to this invention automatically aligns the sheet to be ground down with the template. In addition it allows two grinders to be used, for high production speed. The change in orientation of the template 22 is automatically compensated for by rotation of every other sheet about the axis 26 in the positioning station. Obviously if three grinders 23 were used, the sheet to be ground next would be rotated only through 120°, and if four only through 90°, and so on. The number of steps in each cycle would be increased correspondingly.

We claim:

1. An apparatus for grinding the edges of similar glass sheets whose edges are polygons that are not symmetrical about a point, said apparatus comprising:

a supply station supporting a stack of such sheets with all of the sheets in the stack in vertical registration;

a grinding table at a grinding station adjacent said supply station and rotatable about an upright grinding axis for supporting said sheets during grinding, a template secured to and jointly rotatable with said grinding table;

means including a pair of grinders in said grinding station radially oppositely engageable with the edges of a sheet on said grinding table and radially displaceable by said template;

means including a transporter for transporting said sheets one at a time from said stack in said supply station to said grinding station, said transporter including a glass sheet holder rotatable about a vertical intermediate axis and means for rotating said holder through 180° about said intermediate axis;

means for simultaneously engaging said grinders with the sheet in said grinding station while rotating said grinding table with said template and the sheet on said table through 180° to grind the edges of the sheet on said table, whereby each such grinding operation displaces said template through 180° about said grinding axis;

means for rotating every other sheet while transporting same from said supply station to said grinding station through 180° about said intermediate vertical axis; and means for positioning said sheet on said holder with respect to said intermediate axis.

2. The apparatus defined in claim 1 wherein said intermediate axis is fixed between said supply and grinding stations, said apparatus further comprising a positioning table at and rotatable about said intermediate axis between said stations, whereby said sheets can be rotated through 180° about said intermediate axis by rotation of said positioning table.

3. A method of grinding the edges of similar glass sheets whose edges are polygons that are not symmetrical about a point, said method being carried out in an apparatus having:

a supply station for supporting a stack of such sheets with all of the sheets in the stack in vertical registration, a grinding station adjacent said supply station having a grinding table rotatable about an upright grinding axis and adapted to support said sheets during grinding, a template secured to said grinding table, and a pair of grinders in said grinding station radially engageable with the edges of the sheet on said grinding table and radially displaceable by said template; said method comprising the steps of:

(a) transporting said sheets one at a time from said stack in said supply station past an intermediate station to said grinding station by a transporter;

(b) simultaneously engaging said grinders with the sheet in said grinding station while rotating said grinding table with said template and the sheet on said table through 180° to grind the edges of the sheet on said table, whereby each such grinding operation displaces said template through 180° about said axis;

(c) rotating every other sheet while same is being transported from said supply station to said grinding station through 180° about an intermediate vertical axis;

(d) depositing said sheets in said intermediate station while transporting same to said grinding station;

(e) positioning said sheets in said intermediate station exactly with respect to said transporter; and (f) picking the positioned sheets up with said transporter and continuing their transport to said grinding station, whereby said sheets are exactly held by said transporter after such positioning and can be exactly deposited by said transporter in said grinding station.

4. The method defined in claim 3 wherein steps (b) and (c) take place simultaneously.

5. The method defined in claim 3 wherein said sheets are positioned in said station by being:

deposited on a positioning table in said intermediate station; and shifted horizontally on said positioning table.

6. The method defined in claim 5 wherein said positioning table is rotatable about said intermediate axis to rotate said sheets through 180° while transporting same.

* * * * *